US010566753B2

(12) United States Patent
De Bruijn

(10) Patent No.: US 10,566,753 B2
(45) Date of Patent: Feb. 18, 2020

(54) HINGEABLE CONNECTOR ASSEMBLY

(75) Inventor: Jeroen Jozef Maria De Bruijn, Loon op Zand (NL)

(73) Assignee: Amphenol FCI Asia Pte. Ltd., Singapore (SG)

( * ) Notice: Subject to any disclaimer, the term of this patent is extended or adjusted under 35 U.S.C. 154(b) by 0 days.

(21) Appl. No.: 14/344,079

(22) PCT Filed: Sep. 14, 2012

(86) PCT No.: PCT/EP2012/068139

§ 371 (c)(1),
(2), (4) Date: Mar. 11, 2014

(87) PCT Pub. No.: WO2013/037966

PCT Pub. Date: Mar. 21, 2013

(65) Prior Publication Data

US 2014/0342577 A1 Nov. 20, 2014

(30) Foreign Application Priority Data

Sep. 16, 2011 (WO) ..... PCT/IB2011/002575
May 8, 2012 (WO) ..... PCT/IB2012/001164

(51) Int. Cl.
*H01R 35/04* (2006.01)
*H01R 13/629* (2006.01)
*H01R 43/16* (2006.01)

(52) U.S. Cl.
CPC ..... *H01R 35/04* (2013.01); *H01R 13/629* (2013.01); *H01R 43/16* (2013.01); *Y10T 29/49204* (2015.01)

(58) Field of Classification Search
CPC ..... H01R 12/716; H01R 34/04
USPC .... 439/31, 12, 246, 251, 249, 257; 200/254, 200/255
See application file for complete search history.

(56) References Cited

U.S. PATENT DOCUMENTS 3,190,978 A 6/1965 Huget
4,632,475 A 12/1986 Tomita ..... 339/4
4,657,320 A * 4/1987 Bamford et al. ..... 439/31
(Continued)

FOREIGN PATENT DOCUMENTS

CN 101578739 A 11/2009
CN 201781112 U 3/2011
WO WO 90/09046 8/1990

*Primary Examiner* — Edwin A. Leon
*Assistant Examiner* — Matthew T Dzierzynski
(74) *Attorney, Agent, or Firm* — Wolf, Greenfield & Sacks, P.C.

(57) ABSTRACT

An electrical connector assembly including a first connector with header contact blade (s) and a second connector with receptacle contact blade (s), The connectors are pivotable with respect to each other. The second connector includes a receptacle housing with an entrance for insertion of a header contact blade between a contact surface of the receptacle contact blade and an opposite surface. The entrance allows insertion in an angular range of mating directions within a plane perpendicular to the main pivoting axis. The contact surface of the receptacle contact blade and the opposite surface converge towards the main pivoting axis over said angular range. The receptacle contact blade has a free peripheral portion at the entrance of the receptacle housing, which is resiliently movable with respect to the receptacle housing.

23 Claims, 17 Drawing Sheets

(56) References Cited

U.S. PATENT DOCUMENTS 4,755,143 A * 7/1988 Enomoto et al. ..... 439/31
4,863,387 A * 9/1989 Snaper et al. ..... 439/31
4,865,553 A * 9/1989 Tanigawa et al. ..... 439/31
5,174,761 A * 12/1992 Kodaira ..... 439/31
5,542,850 A 8/1996 Frantz ..... 439/31
5,655,935 A * 8/1997 Yoshimura ..... H01R 13/432 439/748
5,772,447 A * 6/1998 Cheung ..... 439/31
D472,879 S 4/2003 Ouchi et al. ..... D13/147
6,551,143 B2 * 4/2003 Tanaka ..... H01R 12/7088 439/224
7,044,811 B2 * 5/2006 Chritz ..... H01R 9/091 439/856
7,140,895 B2 * 11/2006 Tuin ..... H01R 12/57 439/246
7,189,077 B1 * 3/2007 Eldridge ..... H01L 23/4822 257/E21.582
7,214,067 B2 * 5/2007 Zaderej ..... 439/31
7,575,487 B2 * 8/2009 Yodogawa ..... H01R 13/113 439/830
7,740,511 B2 * 6/2010 Katano ..... H01R 13/113 439/816
7,874,845 B1 1/2011 Tang et al. ..... 439/65
8,057,247 B2 * 11/2011 Katano ..... H01R 13/11 439/251
8,092,236 B2 * 1/2012 Yang ..... H01R 12/7052 439/500
8,246,357 B2 * 8/2012 Chen ..... 439/13
8,317,529 B2 * 11/2012 Katano ..... H01R 13/115 439/251
8,317,535 B2 * 11/2012 Yasui ..... H01R 12/724 439/378
9,413,039 B2 * 8/2016 Kwak ..... H01M 2/0207
2007/0157494 A1 * 7/2007 Barcikowski ..... 40/1.5
2008/0166901 A1 7/2008 Weber ..... 439/79
2012/0021614 A1 1/2012 Chen ..... 439/13

* cited by examiner

HINGEABLE CONNECTOR ASSEMBLY

FIELD OF THE DISCLOSURE

The present invention relates to an electrical connector assembly, comprising two connectors which are pivotable with respect to each other in an assembled condition. The invention also pertains to the individual connectors of such an assembly, including a header connector, a receptacle connector and a hermaphroditic connector providing receptacle contacts as well as header contacts.

BACKGROUND OF THE DISCLOSURE

In many applications it is desirable to connect a circuit board with another component, such as a further circuit board or one or more cables, in such a way that the circuit board and the connected component are rotatable with respect to each other without interrupting the electrical and mechanical connection during such rotation. This is for instance desirable with connection LED strips.

Accordingly there is a need for a hingeable or pivotable connector assembly, particularly for board-to-board or board-to-cable application, enabling easy, reliable and releasable contacting of the header contacts and the receptacle contacts. It is a further object of the invention to provide a connector assembly allowing insertion of one or more header contacts into respective receptacle contacts from a plurality of mating directions.

SUMMARY OF THE DISCLOSURE

In a first aspect, an electrical connector assembly is provided comprising a first connector and a second connector which are pivotable with respect to each other about a main pivoting axis in an assembled condition. The first connector is provided with at least one header contact blade and the second connector has at least one receptacle contact blade for contacting the header contact blade and a receptacle housing with an entrance for insertion of a header contact blade between a contact surface of the receptacle contact blade and an opposite surface facing the contact surface. The entrance is configured to allow insertion in an angular range of mating directions within a plane perpendicular to the main pivoting axis. At least part of the contact surface of the receptacle contact blade and the opposite surface converge towards the main pivoting axis over said angular range of mating directions. The receptacle contact blade has a free peripheral portion at the entrance of the receptacle housing, which is resiliently movable with respect to the receptacle housing at least in a direction parallel to the main pivoting axis.

Due to this feature the receptacle contact blade can be moved with respect to the receptacle housing upon entry of the header contact blade into the receiving member. This allows easy and effective insertion of the header contact, while avoiding internal stress within the receptacle housing particularly with an assembly according to claim 2.

Multidirectional accessibility is further improved with a double curved contact surface as provided with claim 3.

The surface opposite to the contact surface of the receptacle contact can be part of the same receptacle contact. This way, the respective header contact can be received between two resilient clamping blades of a same contact.

In a refinement, the assembly can be according to claim 5 providing symmetrical receptacle contacts.

In a specific embodiment the assembly can be according to claim 6, thus avoiding that the housing would limit the freedom of relative rotation of the two connectors.

The connectors of the assembly can for instance be hermaphroditic connectors, both provided with one or more header contacts and receptacle contacts. In that case, the first and second connector may have identical configurations, if so desired.

Alternatively, the first connector is a header connector provided with one or more header contacts while the second connector is a receptacle connector provided with one or more receptacle contacts.

In a further refinement, the assembly can be in accordance with claim 10. This allows easy and releasable mechanical coupling of the two connectors without restricting the freedom of rotation. Such an assembly can for example be configured in accordance with claim 11.

In a further aspect, an electrical connector assembly is disclosed, comprising a first connector and a second connector which are pivotable with respect to each other about a pivoting axis in an assembled condition, the first connector being provided with at least one header contact and the second connector having at least one receptacle contact with two opposite contact faces or blades receiving the header contact, wherein the receptacle contact faces and the header contact are provided with complementary spherical concave and convex surface sections in line with the pivoting axis. The spherical recesses can for instance be coined holes in the contact blades. When the two connectors are assembled the convex surface sections will guide themselves into the corresponding recesses. The retention forces mutually exerted by the contact blades are enhanced, while, on the other hand, pivoting is not hindered.

In a specific embodiment, the header contacts are each provided with a spherical concave recess, while the receptacle contacts are provided with a spherical convex surface.

If the spherical radius of the spherical counter surface is larger than the spherical radius of the recesses, a substantially ring shaped contact zone is obtained. This results in a larger contact area. Particularly in such a case accurate positioning results in a better contact. To this end, the first and second connectors can be joint by a latch of one connector cooperating with a counter surface on the mating connector, the latch and the counter surface being provided with complementary spherical recesses and bulges in line with the pivoting axis.

In an alternative embodiment, the spherical radius of the bulges can be made smaller than the spherical radius of the recesses. This results in a point contact. Although such a point contact requires less accurate positioning, it can also be combined with the aforementioned bulged latch joint.

In a further aspect, an electrical connector assembly is disclosed, comprising a first connector and a second connector which are pivotable with respect to each other about a main pivoting axis in an assembled condition, the first connector being provided with at least one header contact and the second connector having at least one receptacle contact. The contacts have a surface mounting end for connection to a circuit board and a mating end contacting a matching contact. The surface mounting ends of the first connector are positioned at a side opposite to the side of the second connector exposing the surface mount ends of the second connector. This way, circuit boards connected by the connector assembly are at a different level when positioned in a parallel orientation, being spaced by the connector assembly. This makes it possible to pivot a circuit board between a +90 degrees position and a −90 degrees position relative to the other circuit board.

In a further aspect, an electrical connector assembly is disclosed, comprising a first connector and a second connector which are pivotable with respect to each other about a main pivoting axis in an assembled condition, the first connector being provided with at least one header contact and the second connector having at least one receptacle contact. The contacts have a surface mounting end for connection to a circuit board and a mating end contacting a matching contact. The first and second connectors are provided with respective connector housings with a surface mount side exposing the surface mounting ends of the contacts, and a mating side exposing the mating ends of the contacts. The connector housings have a lower side provided with a ridge between the surface mount side and the mating side. The ridge increases the creep distance between the mating ends of the contacts one the one hand and the circuit board on the other.

In a specific embodiment, the first connector comprises at least one cylindrical surface with an axis parallel to the main pivoting axis, the cylindrical surface engaging a counter surface of the second connector during hinging. Optionally, the cylindrical surface and the counter surface are provided with complementary profiles, such as complementary ribs extending parallel to the hinging axis, to enable stepwise relative rotation of the connectors, e.g., as with a gearwheel.

Further, a receptacle contact is disclosed for being incorporated in a receptacle of the assembly as described hereinbefore and to a method of manufacturing such a receptacle contact. In the assembled condition of the receptacle connector, the two folding lines act as pivoting axis for resiliently pivoting of the contact blades. The freedom of pivoting movement is enhanced by having the two folding lines under an angle with each other.

The first connector of the connector assembly can be a header connector while the second connector is a receptacle connector. Alternatively, both connectors can be hermaphroditic connectors, e.g., showing identical configurations.

The header contacts and the receptacle contacts are made of an electro-conductive material.

BRIEF DESCRIPTION OF THE DRAWINGS

The invention will hereafter be elucidated with reference to the schematic drawings showing embodiments of the disclosed connector assemblies by way of example.

DETAILED DESCRIPTION OF EMBODIMENTS

Figure 3:
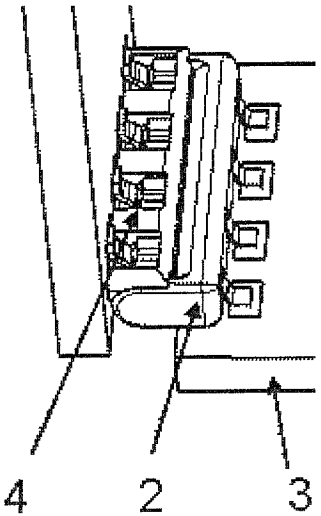
FIGS. 2 and 3 show the assembly of FIG. 1 in different positions.
Figure 2:
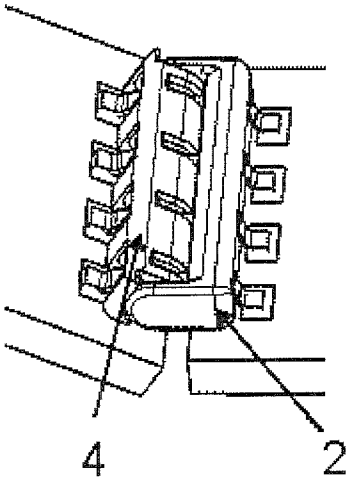
Figure 1:
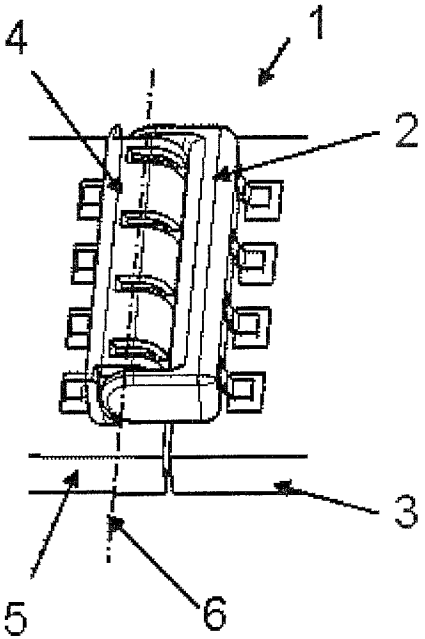
FIG. 1 is a perspective view of an embodiment of an electrical connector assembly.

FIGS. 1-3 show an embodiment of an electrical connector assembly 1 in assembled condition according to the invention. The electrical connector assembly 1 comprises a first connector 2 which is a header connector mounted to a first printed circuit board 3 and a second connector 4 which is receptacle connector mounted to a second printed circuit board 5. The header 2 and the receptacle 4 are pivotable with respect to each other about a main pivoting axis 6. FIGS. 1-3 illustrate that the electrical connector assembly 1 allows to pivot the printed circuit boards 3, 5 with respect to each other, whereas the electrical and mechanical connections are maintained.

Figure 4A:
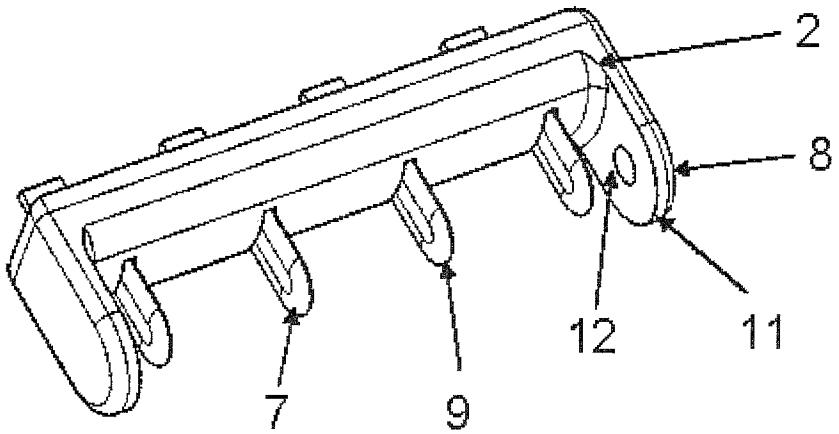
FIGS. 4A and 4B show two respective perspective views of a header connector of the embodiment of FIGS. 1-3, as seen from opposite sides.
Figure 4B:
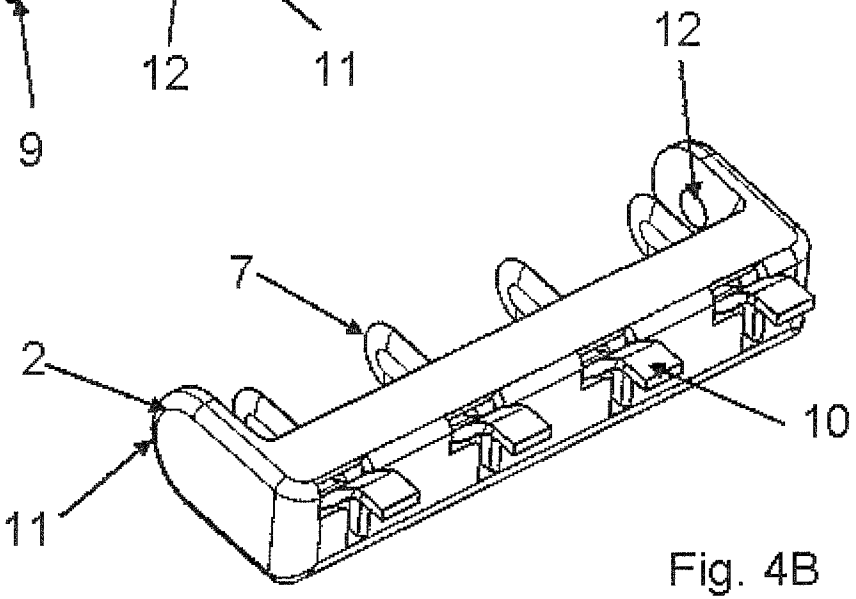

FIGS. 4A and 4B show two perspective views of an individual header connector 2 which is provided with electro-conductive header contact blades 7. The contact blades 7 are fixed in a header housing 8. The contact blades 7 comprise a semi-circular mating end 9, which is directed towards the pivoting axis 6 in assembled condition, and an opposite surface mount end 10, which can be surface mounted to a circuit board, for instance by soldering. The mating end 9 is under a right angle with the surface mount end 10. The header housing 8 is also provided with lateral terminal guiding surfaces 11 with inwardly spherical latching pegs 12.

Figure 5A:
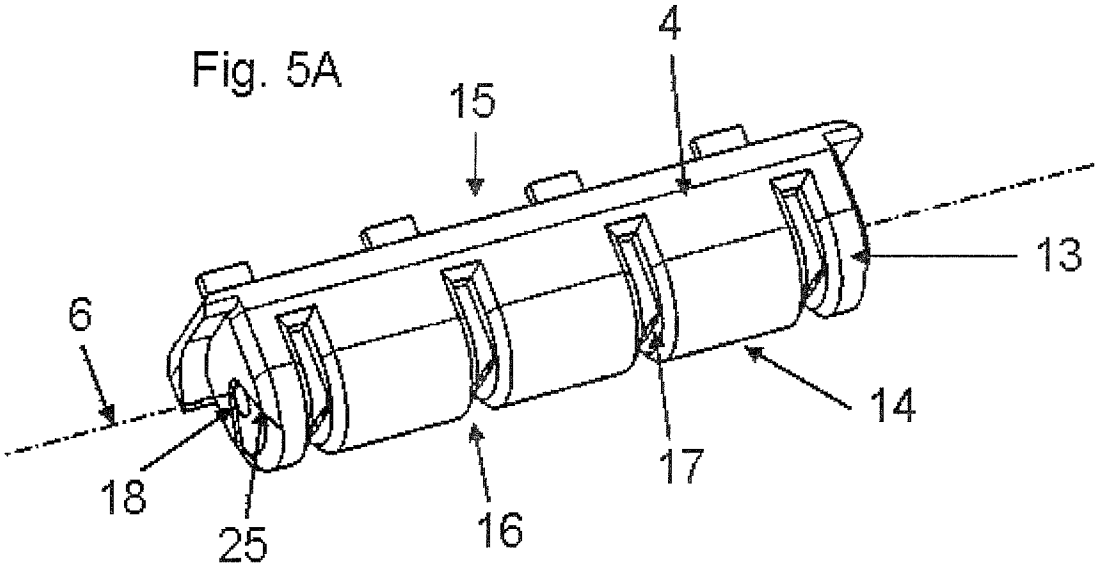
FIGS. 5A and 5B show two respective perspective views of a receptacle connector of the embodiment of FIGS. 1-3, as seen from opposite sides.
Figure 5B:
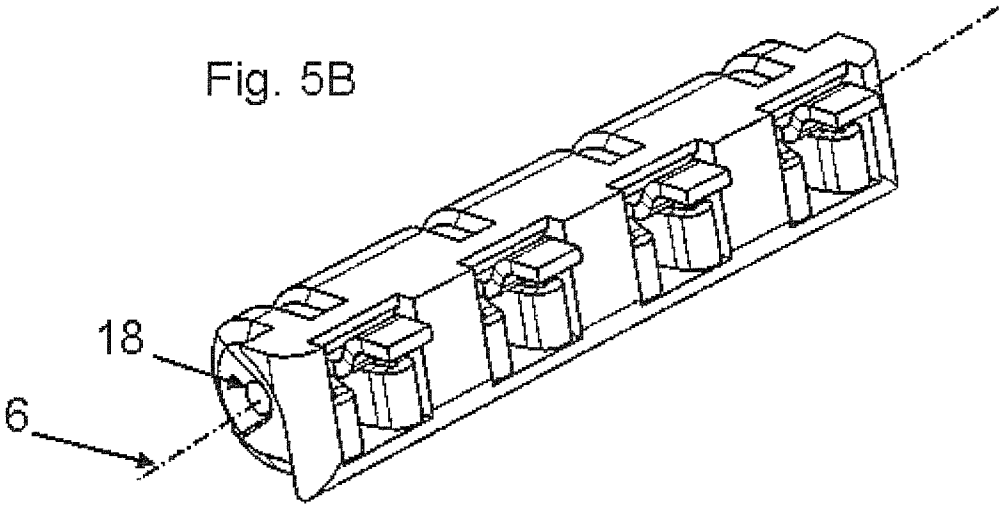
Figure 6:
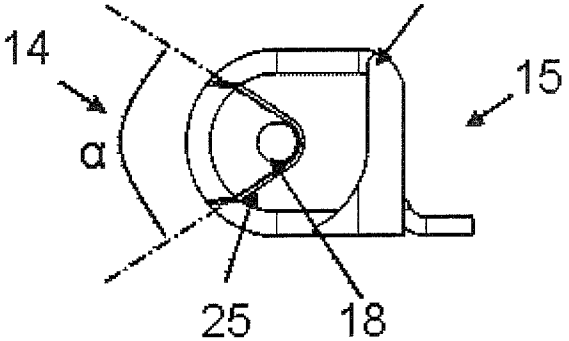
FIG. 6 shows a side view of the receptacle connector of FIG. 5A.
Figure 7:
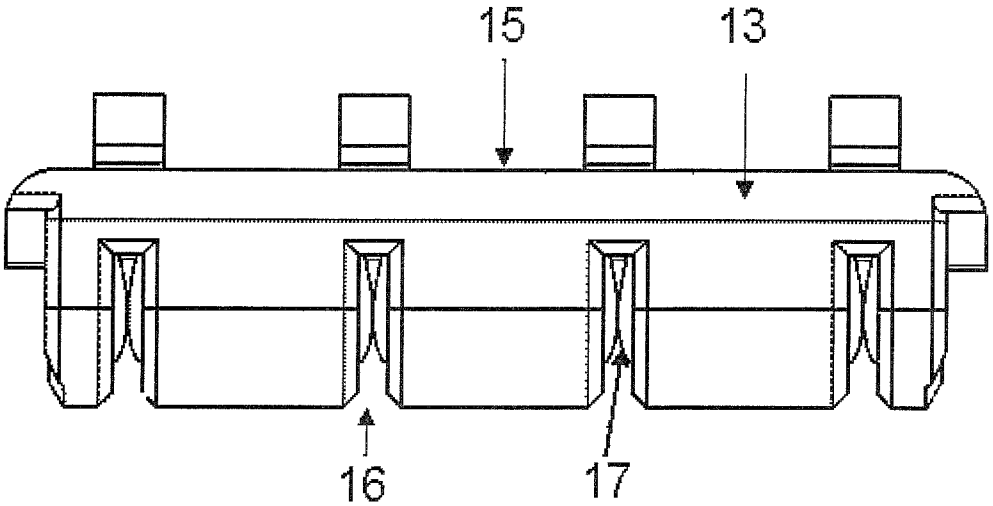
FIG. 7 is a plan view of the receptacle according to FIG. 5A.

FIGS. 5A and 5B show two perspective views of the receptacle connector 4 which comprises a receptacle housing 13 with a semi-circular mating side 14 with a centre line substantially coinciding with the main pivoting axis 6, and an opposite flat surface mount end 15. The semi-circular mating side 14 of the housing 13 is provided with circumferentially extending entrances 16 into which respective header contact blades 7 can be inserted to contact receptacle contacts 17. The entrances 16 are semi-circular slits centred about the central pivoting axis 6. Due to the semi-circular shape of the entrances 16, the header contact blades 7 can be inserted into the entrances 16 in any direction within an angular range α with respect to the main pivoting axis 6 within a plane substantially perpendicular to the pivoting axis 6, as shown in FIG. 6.

The side faces of the receptacle housing 13 are provided with latching holes 18 for receiving the latching pegs 12 of the header 2 to form a ball snap joint for mechanically attaching the two connectors 2, 4 without restricting the freedom of rotation about the main pivoting axis 6. A V-shaped guiding ledge 25 on the side surface serves to guide a latching peg towards the latching hole 18 during assembly.

Figure 8:
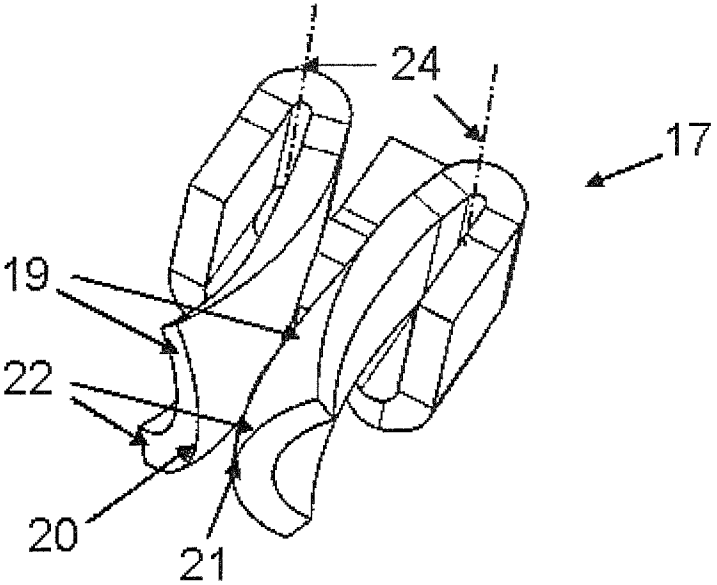
FIG. 8 is a perspective view of an embodiment of a receptacle contact.

FIG. 8 shows a perspective view of a receptacle contact 17 as a separate part. The receptacle contact 17 is symmetrical with respect to a plane extending transversely to the main pivoting axis 6, and comprises opposite contact blades 19 with opposite contact surfaces 20, 21 between which the corresponding header contact blade 7 is received in the assembled condition. The blades 19 have free peripheral portions 22 positioned at the entrance 16 in an assembled condition of the receptacle connector 4. The peripheral portions 22 are resiliently movable with respect to the receptacle housing 13 in a direction parallel to the main pivoting axis 6. This way the receptacle contact blades 19 are pivotable with respect to the receptacle housing 13 about a blade pivoting axes 24. The blade pivoting axes 24 extend transversely with respect to the main pivoting axis 6 and in this case the blade pivoting axes 24 are substantially parallel with each other. The contact surfaces 20, 21 of the contact blades 19 are double curved and are convex in radial and in circumferential direction relative to the main pivoting axis 6. This way, the two opposite contact surfaces 20, 21 of the receptacle contact 17 converge towards each other along the full run of the semi-circular entrances 10 and, consequently, over at least a sub-range of the angular range α of mating directions.

At the opposite end the receptacle contact 17 comprises a surface mount end 23 for mounting the receptacle connector 4 to a circuit board, for instance by soldering.

Figure 9B:
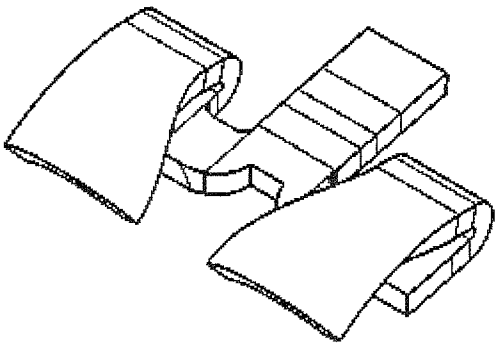
FIG. 9A-C show consecutive steps of a method to manufacture the receptacle contact of FIG. 7.
Figure 9C:
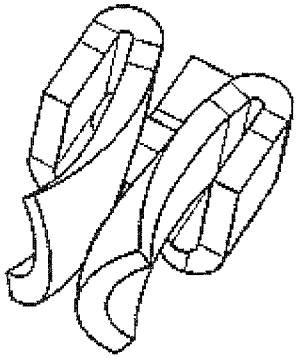
Figure 9A:
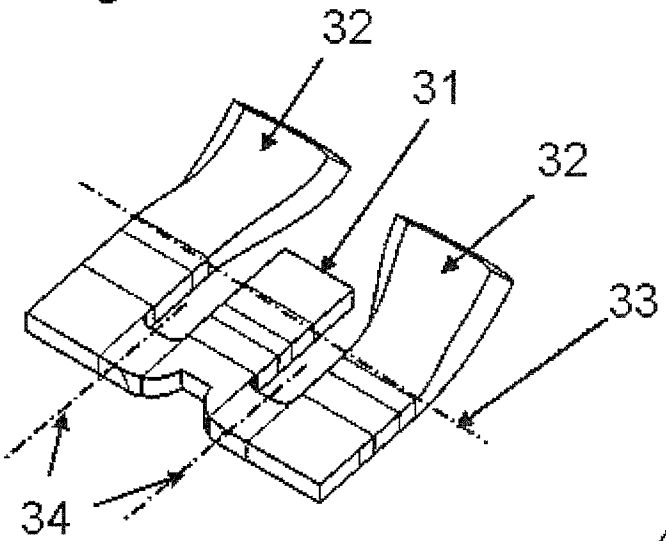

The receiving member 10 as shown in FIG. 8 can be made from a blank of an electro-conductive material, as illustrated in FIG. 9A-C. FIG. 9A shows a blank 30 having a base 31 and two substantially parallel legs 32 protruding from the base 31. The legs 32 are folded into U-shapes about a first folding line 33 which extends transversely with respect to the legs 32 (see FIG. 9B). In a next step the base 31 is folded about a second folding line 34 extending parallel to the legs 32 such that free end portions of the legs 32 form opposite blades 19. The two folding lines 33, 34 of the legs 32 form resilient hinges such that the opposite blades 19 are pivotally connected to the base 13. The resulting receptacle contact 17 as shown in FIG. 9C can be fixed into the receptacle housing 13. The end portions of the legs 14 can be made convex by bending the end portions before bending the legs 32 into U-shapes.

Figure 11:
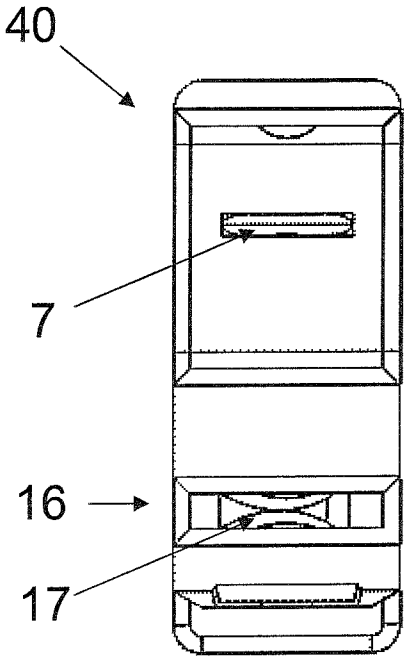
FIG. 11 shows a side view of the connector of FIG. 10.
Figure 10:
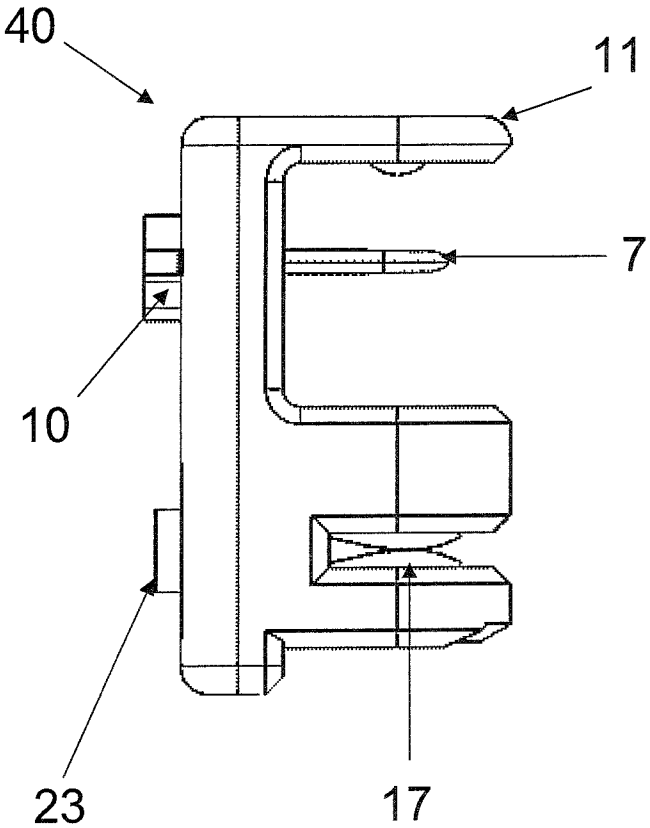
FIG. 10 shows a plan view of a hermaphroditic connector.
Figures 12, 13:
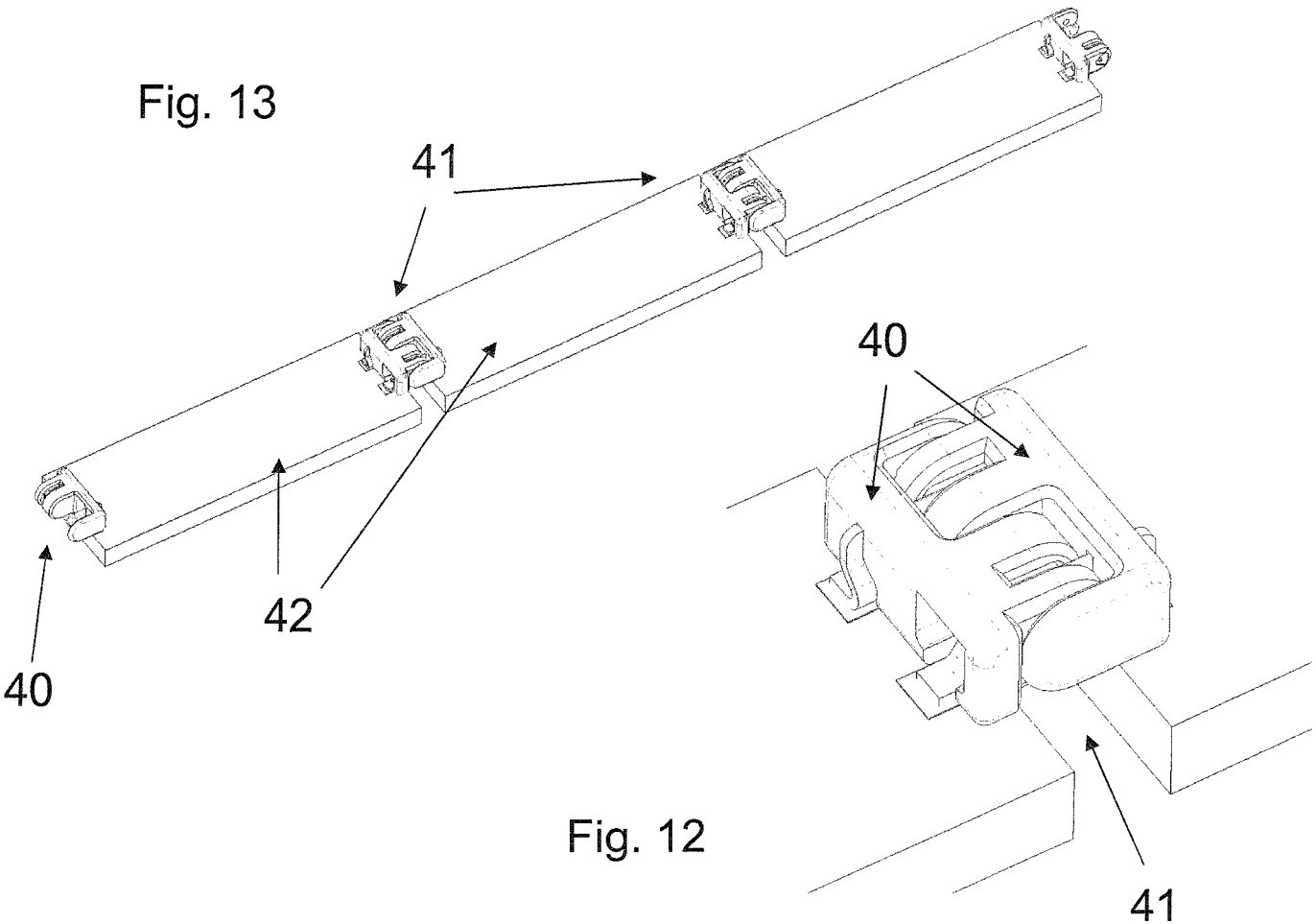
FIG. 12 shows a connector assembly of two connectors according to FIG. 10.
FIG. 13 shows a series of LED strips connected by assemblies according to FIG. 12.

FIGS. 10 and 11 show a hermaphroditic connector 40 comprising a header contact 7 and a receptacle contact 17, both as described here above. The connector 40 can be connected to a connector of identical configuration to form a connector assembly 41, as shown in FIG. 12. FIG. 13 shows a series of LED strips 42 connected by means of such connector assemblies 41.

Figure 16:
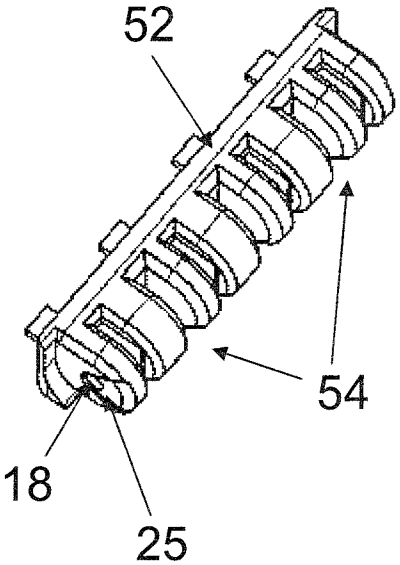
FIG. 16 shows a receptacle connector of the connector assembly of FIG. 14.
Figure 15:
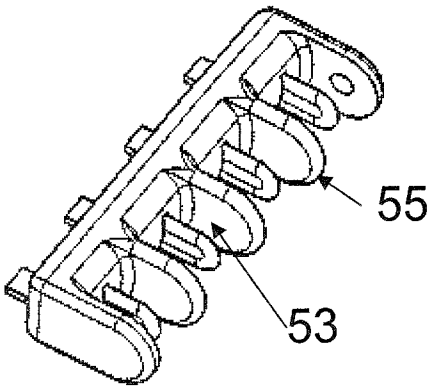
FIG. 15 shows a header connector of the connector assembly of FIG. 14.
Figure 14:
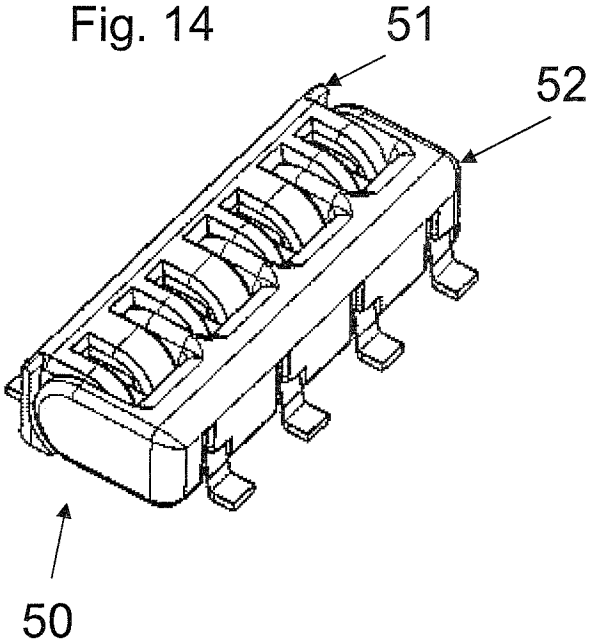
FIG. 14 shows an alternative connector assembly.

FIG. 14 shows a third embodiment of a connector assembly 50 comprising a header connector 51, shown in more detail in FIG. 15, and a receptacle connector 52, shown in more detail in FIG. 16. The connectors 51, 52 are similar to the header connector 2 and receptacle connector 4 of FIG. 1, with the difference that the header connector 51 comprises partitions 53 between each pair of contact blades 7, whereas the receptacle connector 52 comprises corresponding receiving spaces 54 for receiving the partitions 53 when the connector assembly 50 is in an assembled condition. The partitions 53 have a semi-circular end 55 at the mating side of the header connector 51 with a center in line with the main pivoting axis 6 to avoid restriction of freedom of rotational movement.

Figure 17:
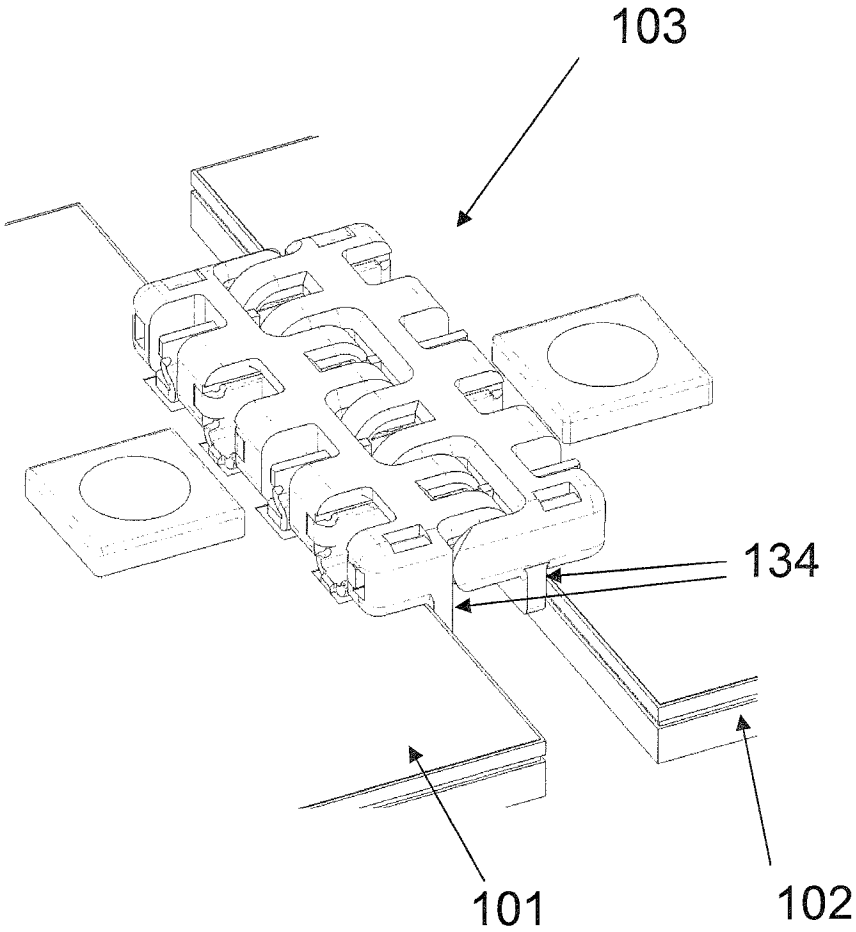
FIG. 17 is a perspective view of an embodiment of an electrical connector assembly.

FIG. 17 shows two circuit boards 101, 102 connected by a pivotable connector assembly 103 comprising two mating identical hermaphroditic connectors 104. An example of such a connector is shown in more detail in FIG. 18, which is different from the connector in FIG. 17 in that it does not have a ridge 134 at its lower side, as will be discussed hereinafter with reference to FIG. 25. The connector 104 comprises a connector housing 105, with a mating side 106 with receptacle blocks 107 having a semi-cylindrical mating end 108. The distance between the receptacle blocks 107 corresponds to the width of the receptacle blocks 107. This way, the receptacle blocks 107 fit between the receptacle blocks 107 of a mating connector 104.

One of the ends of the connector comprises a terminal latch 109 with a contour following the semi-cylindrical contour of the receptacle blocks 107. On its side facing the closest receptacle block 107, the terminal latch 109 is provided with a spherical bulge 110. The receptacle block 107 at the opposite side comprises a recess 111 shaped to cooperate with the bulged terminal latch 109 of a mating connector 104 as a ball joint in a pivoting manner. The distance between the terminal latch 109 and the closest receptacle block 107 is the same as the distance between the receptacle blocks 107.

Figure 19:
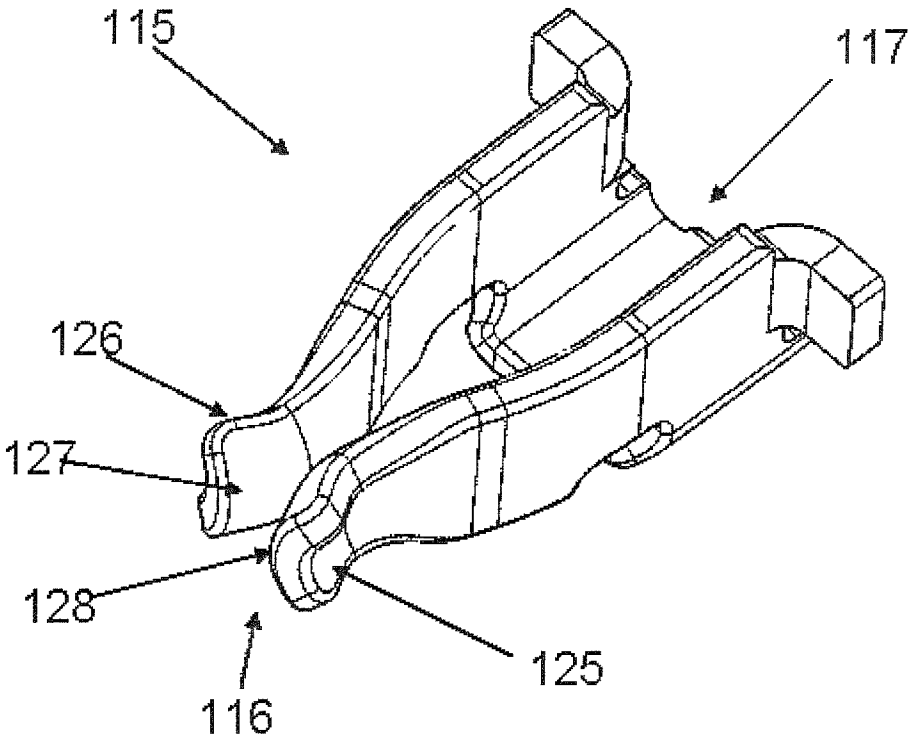
FIG. 19 shows in perspective view a receptacle contact of the connector of FIG. 18.

The connectors 104 further comprises header contacts 112 with a mating end 113 and a surface mount end 114 (see FIG. 20), and receptacle contacts 115 with a mating end 116 and a surface mount end 117 (see FIG. 19). The mating ends 112 of the header contacts 112 project from the connector housing in a position centrally between two receptacle blocks 107, the last header contact being between the terminal latch and the closest receptacle block 107. Both side faces of the header contacts 112 are provided with a spherical recess 118, which are in line with the spherical bulge 110 of the terminal latch 109 and with the recess 111 in the outer surface of the terminal receptacle block 107. The imaginary line through the spherical recesses and the bulge on the terminal latch forms a pivot axis 119 (see FIG. 4).

The receptacle blocks 107 are provided with a central slit 120 providing access for a header contact 112 of a mating connector 104 for engaging a respective receptacle contact 115.

The connector side opposite to the mating side 106 is a surface mount side 121 provided with indentations 122 exposing the surface mount ends 114, 117 of the header contacts 112 and the receptacle contacts 115 to enable surface mounting of the contacts 112, 115 onto a circuit board 101, 102, as shown in FIG. 17. Surface mounting can for instance take place by soldering, through hole soldering, press fit or any other suitable surface mount technique.

Figure 20:
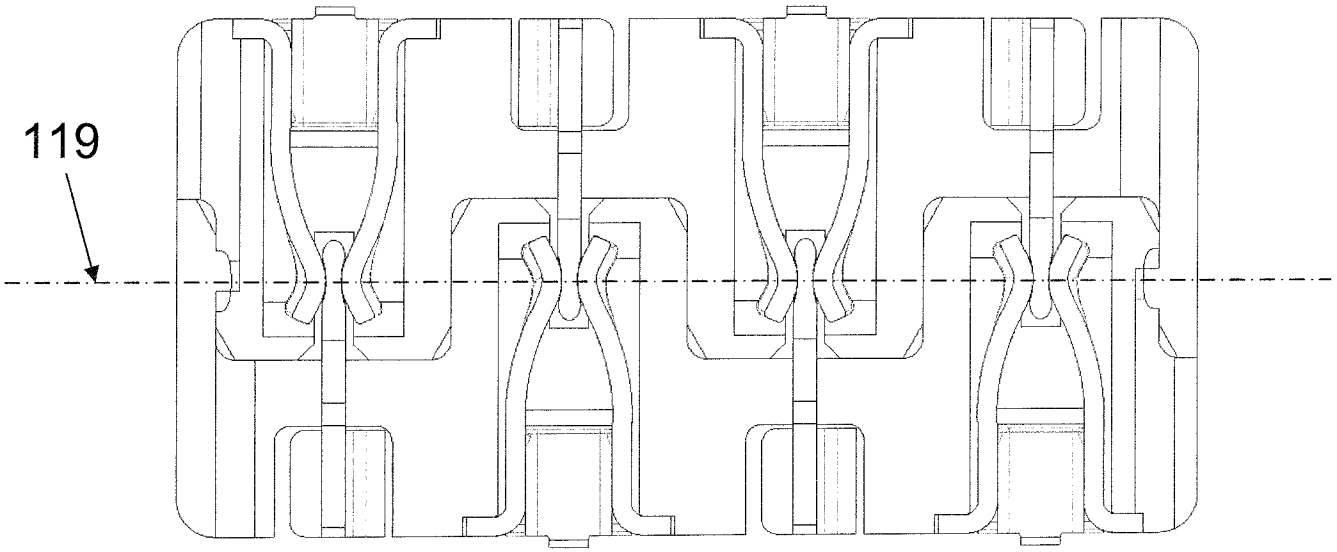
FIG. 20 shows in cross section two mating hermaphroditic connectors of the type shown in FIG. 18.

FIG. 19 shows a perspective view of a receptacle contact as a separate part. The receptacle contact 115 is symmetrical with respect to a plane extending transversely with respect to the main pivoting axis 119 (see FIG. 20), and comprises a mating end 116 with two contact blades 125, 126 providing opposite contact surfaces 127, 128 between which a corresponding header contact blade can be received. The contact surfaces 127, 128 of the contact blades 125, 126 are convex. This way, the two opposite contact surfaces 127, 128 of the receptacle contact 115 converge towards each other along the full periphery of the semi-circular slits 120 of the respective receptacle block 107. When mounted in a connector 104 the distance between the two opposite convex contact surfaces 127, 128 is smallest at the position of the pivoting axis 119. This way, the convex contact surfaces 127, 128 cooperate with the spherical recesses 118 in the header contacts 112 in a pivoting manner like a ball joint, as shown in FIG. 20.

At the opposite end the receptacle contact 115 comprises a surface mount end 117 for mounting the receptacle connector to a circuit board 101, 102, for instance by soldering.

Figure 22:
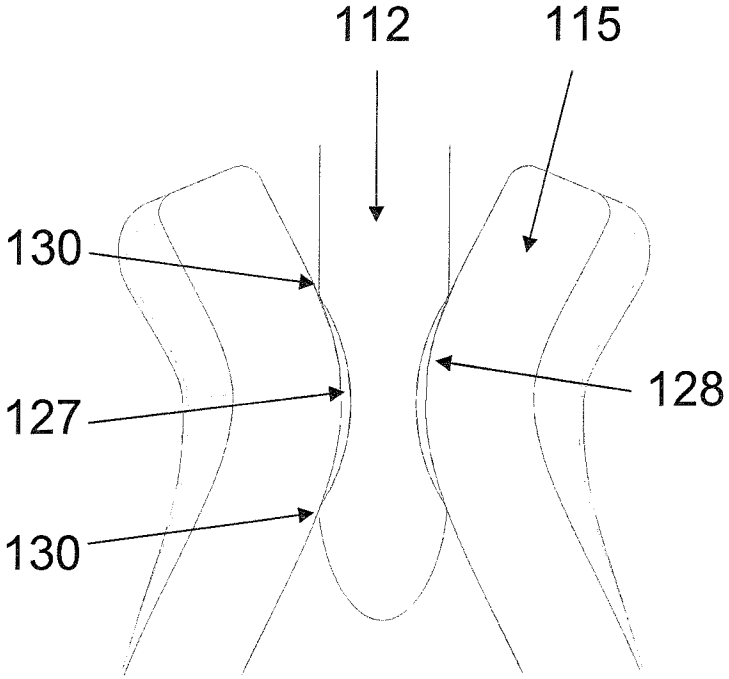
FIG. 22 shows schematically in detail a mating end of a receptacle contact engaging a mating end of a header contact of an alternative exemplary embodiment of a connector assembly.
Figure 21:
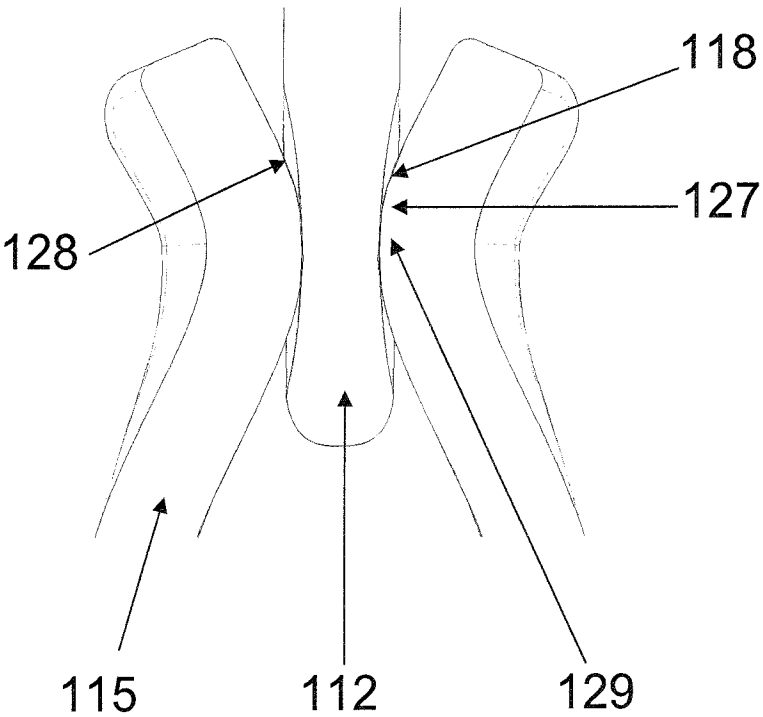
FIG. 21 shows schematically in detail a mating end of a receptacle contact engaging a mating end of a header contact of an exemplary embodiment of a connector assembly.

Within dimensional tolerances the spherical radius of the convex contact surfaces 127, 128 of the receptacle contact 115 can be equal to the spherical radius of the spherical recess 118 of the header contacts 112. However, it can be advantageous to make the radius of the contact surfaces 127, 128 smaller (see FIG. 21) or larger (see FIG. 22) than the radius of the recesses 118. In the first case, a point contact 129 is obtained near or at the location of the pivoting axis 119. In such a case, accurate positioning is less critical. If the spherical radius of the convex contact surfaces 127, 128 is larger than the radius of the recess 118 in the header contact 112, a ring contact 130 is obtained. This has the advantage that a larger contact area can be realized. Such a large contact area can particularly be obtained by improving accurate positioning, for instance by use of the ball joint mechanism provided by the terminal latch 109 and the matching recess 111 in the outer surface of the cooperating receptacle block 107.

Figure 18:
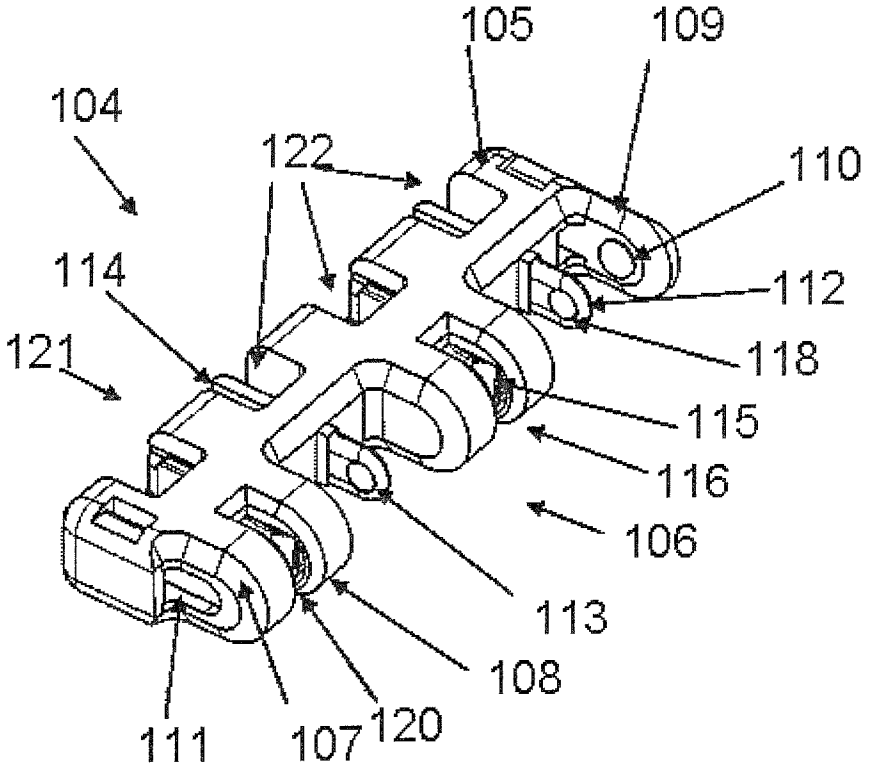
FIG. 18 shows in perspective view an exemplary embodiment of a connector.
Figure 23:
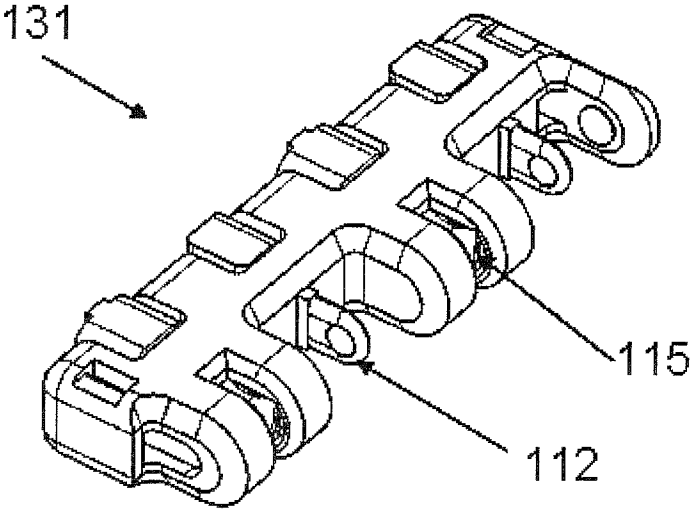
FIG. 23 shows in perspective view a further exemplary embodiment of a connector.
Figure 24C:
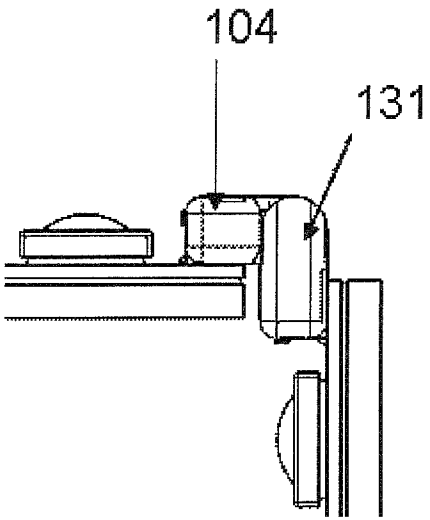
FIGS. 24A-C show different positions of two pivoting connectors.
Figure 24B:
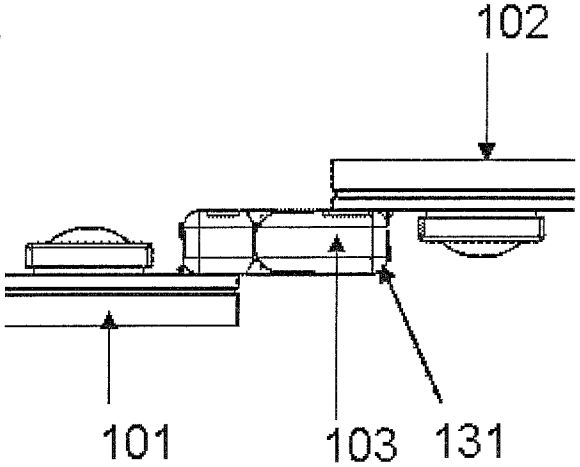
Figure 24A:
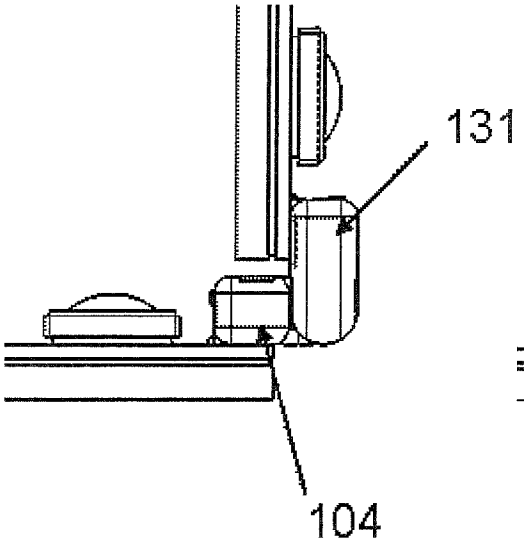

FIG. 23 shows an alternative embodiment of a connector 131, which is substantially identical to the connector shown in FIG. 18, with the difference that the header contacts 112 and receptacle contacts 115 are positioned upside down within the connector housing 105. Using a connector assembly combining such a connector 131 with a connector 104 of FIG. 18 makes it possible to connect a first circuit board at the lower side of the connector assembly 103 with a second circuit board 102 at the top side of the connector assembly. This is shown in FIG. 24B. This way, the second circuit board 102 can be moved between a +90 degrees position and a −90 degrees position relative to the first circuit board 101, as shown in FIGS. 24A and 24C respectively.

Figure 25:
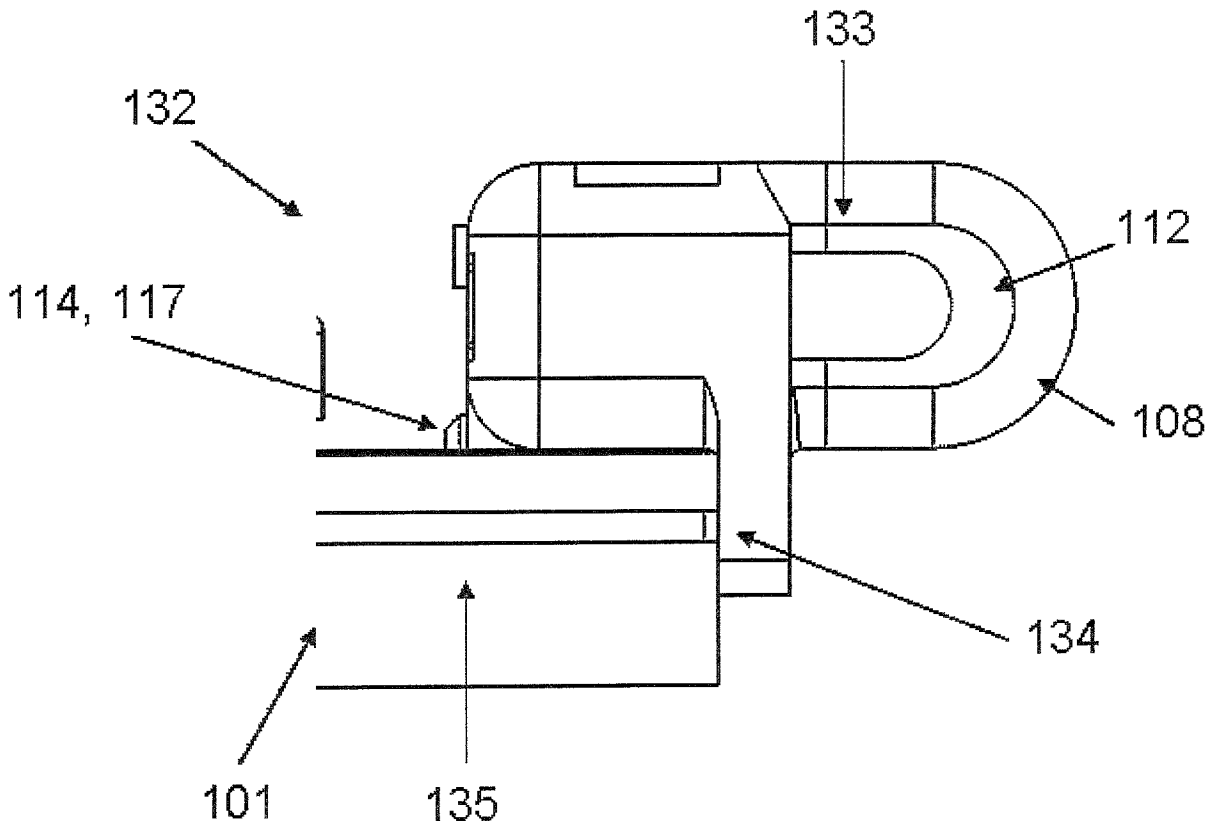
FIG. 25 shows in cross section a further exemplary embodiment of a connector.

FIG. 25 shows in cross section a further embodiment of a connector 132, similar to the connector 104 of FIG. 18. The connector 132 is mounted on the edge of a circuit board 1. The housing 133 of this connector 132 comprises a ridge 134 between the surface mount ends 114, 117 of the contacts 112, 115 and the semi-cylindrical mating side 108 of the housing 133. The ridge 134 enhances the creep distance between the electroconductive parts 135 of the circuit board and the electroconductive parts 112, 115 of the mating end of the connector 132.

Figure 26B:
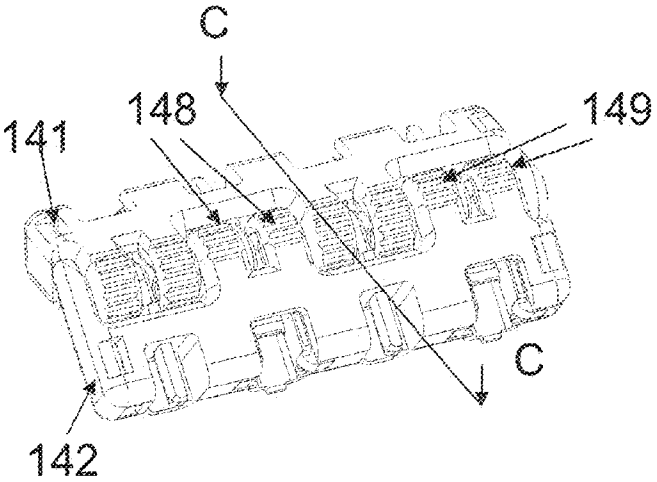
FIG. 26A-C show a further exemplary embodiment of a connector in perspective views and side view respectively.
Figure 26A:
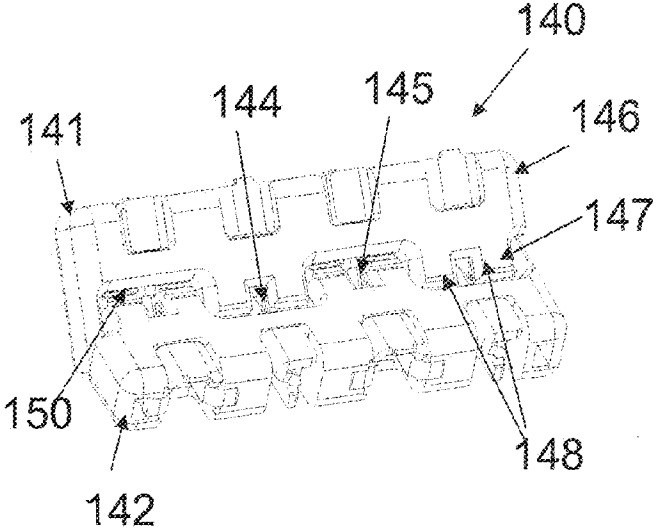
Figure 26C:
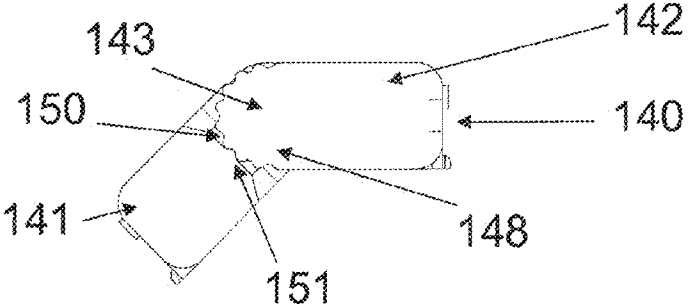

FIGS. 26A-C shows a further exemplary embodiment of a connector assembly 140 with a first connector 141 and a second connector 142 which are pivotable with respect to each other about a main pivoting axis 143 (see FIG. 26C) in an assembled condition. FIGS. 26A and 26B show the assembly 140 in perspective views from two opposite sides. FIG. 26C shows a cross section along line C-C in FIG. 26B. In this embodiment, the first and second connector 141, 142 are identical and interchangeable. As with the embodiment of FIG. 17, the first and second connectors 141, 142 are provided with header contacts 144 and receptacle contacts 145 receiving the header contacts 144. The connectors 141, 142 comprise a connector housing 146 with receptacle blocks 147 having a semi-cylindrical mating end 148. The distance between the receptacle blocks 147 corresponds to the width of the receptacle blocks 147. This way, the receptacle blocks 147 of the first connector 141 fit between the receptacle blocks 147 of the second connector 142 and vice versa.

In the embodiment of FIGS. 26A-C the semi-cylindrical ends 148 are provided with ribs 149 extending in a direction parallel to the main pivoting axis 143. In the assembled condition the ribbed semi-cylindrical ends 148 face a recessed surface 150 of the mating connector. The recessed surface 150 is provided with a single rib 151 (see FIG. 26C) dimensioned to cooperate with the ribs 149 of the ribbed semi-cylindrical end 148. This way, the two connectors 141, 142 can be rotated relative to each other in a stepwise manner and the connectors 141, 142 are biased to a limited number of relative positions.

The invention is not limited to the embodiment shown in the drawings and described hereinbefore, which may be varied in different manners within the scope of the claims.

The invention claimed is:

1. An electrical connector assembly, comprising:

a first connector and a second connector which are pivotable with respect to each other about a main pivoting axis, the first connector comprising at least one header contact blade, and the second connector comprising:

at least one receptacle contact for contacting the header contact blade, the receptacle contact comprising a first receptacle contact blade and a second receptacle contact blade, and a receptacle housing with an entrance for insertion of the header contact blade between contact surfaces of the first receptacle contact blade and the second receptacle contact blade, the entrance being semi-circular so as to enable insertion in an angular range ($\alpha$) of mating directions within a plane perpendicular to the main pivoting axis, wherein;

each of the first receptacle contact blade and the second receptacle contact blade comprises a conductive leg elongated along a longitudinal axis and terminating in a free peripheral portion at the entrance of the receptacle housing, the free peripheral portion being resiliently movable with respect to the receptacle housing at least in a direction parallel to the main pivoting axis, the peripheral portion of each of the first and second receptacle contact blades comprises a sheet of metal bent into curves along the longitudinal axis of the leg and an axis perpendicular to the longitudinal axis of the leg such that:

the contact surface of each of the first and second receptacle contact blades curves away from the plane of the longitudinal axis of the leg at the free peripheral portion and is convex in a cross section through an axis perpendicular to the longitudinal axis of the leg to form a continuous curve comprised of bends in two different axes such that the first and second receptacle contact blades are adjacent each other over a majority of the angular range of the entrance to the receptacle housing, such that an end surface at the distal most tip of each receptacle contact blade bowed outwardly away from the other receptacle contact blade; and the contact surfaces of the first receptacle contact blade and the second receptacle contact blade converge towards each other over said angular range of mating directions.

2. An assembly according to claim 1, wherein the first and second receptacle contact blades are pivotable with respect to the receptacle housing about a blade pivoting axis which extends transversely with respect to the main pivoting axis.

3. An assembly according to claim 1, wherein, for each receptacle contact of the at least one receptacle contact, the contact surface of the first receptacle contact blade faces the contact surface of the second receptacle contact blade.

4. An assembly according to claim 3, wherein the receptacle contact is symmetrical with respect to a plane which extends transversely with respect to the main pivoting axis.

5. An assembly according to claim 1 wherein the first connector is a header connector provided with one or more header contacts and the second connector is a receptacle connector provided with one or more receptacle contacts.

6. An assembly according to claim 1 wherein the first connector comprises at least one side end with a header contact flanked by a terminal guiding surface, wherein a side end of the housing of the second connector and the terminal guiding surface are shaped to form a rotatable and releasable ball snap joint.

7. An assembly according to claim 6 wherein the ball joint is formed by a spherical recess in a lateral surface of the second connector and a complementary spherical projection of the terminal guiding surface of the first connector, wherein the lateral surface is provided with a guiding ledge for guiding the spherical projection into the spherical recess.

8. An assembly according to claim 1, wherein the first and second receptacle contact blades comprise two opposite receptacle contact faces receiving the header contact blade, wherein the receptacle contact faces and the header contact blade are provided with complementary spherical concave and convex surface sections in line with the pivoting axis.

9. An assembly according to claim 8, wherein the header contact blade is provided with a spherical recess and wherein the contact faces of the first and second receptacle contact blades comprise complementary convex surface sections.

10. An assembly according to claim 8 wherein a spherical radius of the spherical concave surface sections is larger than a spherical radius of the convex surface sections.

11. An assembly according to claim 8 wherein a spherical radius of the spherical concave surface sections is smaller than a spherical radius of the convex surface sections.

12. An assembly according to claim 1 wherein the first and second connectors are joint by at least one latch of one connector cooperating with a counter surface on the mating connector, the latch and the counter surface being provided with complementary spherical recesses and bulges in line with the pivoting axis.

13. An assembly according to claim 1 wherein at least one of the connectors is provided with a ridge of an isolative material at the side of the surface mount ends.

14. An assembly according to claim 1 wherein the first connector comprises at least one cylindrical surface with an axis parallel to the main pivoting axis, the cylindrical surface engaging a counter surface of the second connector during hinging, wherein the cylindrical surface and the counter surface are profiled to enable stepwise relative rotation of the connectors.

15. A connector for use in an assembly according to claim 1 wherein the connector is a header connector, a receptacle connector or a hermaphroditic connector.

16. A receptacle contact for being incorporated in a connector of the assembly according to claim 1.

17. A receptacle contact according to claim 16, wherein free end portions of the legs diverge in a direction away from the base, wherein contact surfaces which face to each other at the free end portions are convex.

18. An assembly according to claim 1, where the first and second connectors comprise position biasing ribs configured to bias the first and second connectors to a limited number of positions relative to each other.

19. An assembly according to claim 1, where the first connector comprises an end having a curved portion, where the second connector comprises an end having a recessed portion, where the curved portion is located at least partially in the recessed portion, and where the curved portion and the recessed portion are sized and shaped to provide a stepwise movement of the first and second connectors relative to each other with a limited number of relative positions.

20. An assembly according to claim 1, wherein the header blade includes spherical recesses along its contact surfaces complementary with the contact surfaces of the first and second receptacle contact blades.

21. An electrical connector assembly, comprising:

a first connector and a second connector which are pivotable with respect to each other about a main pivoting axis, the first connector comprising a header housing and at least one header contact blade, wherein the header housing extends beyond either side of the header contact blade defining a recess containing the header contact blade, and the second connector comprising at least one receptacle contact for contacting the header contact blade, the receptacle contact comprising a first receptacle contact blade and a second receptacle contact blade, and a receptacle housing with an entrance for insertion of the header contact blade between contact surfaces of the first receptacle contact blade and the second receptacle contact blade, the entrance being semi-circular so as to enable insertion in an angular range ($\alpha$) of mating directions within a plane perpendicular to the main pivoting axis, the housing extending beyond the contact blades on either side of the first and second receptacle contact blades such that a slot is formed by the housing which serves as the entrance, wherein, each of the first and second receptacle contact blades comprises a conductive leg elongated along a longitudinal axis and terminating in a free peripheral portion at the entrance of the receptacle housing, the free peripheral portion being resiliently movable with respect to the receptacle housing at least in a direction parallel to the main pivoting axis, wherein, the contact surface of each of the first and second receptacle contact blades comprises a sheet of stamped metal bent into curves along two axes such that it is convex in a cross section in at least two radial directions relative to the main pivoting axis to form a continuous curve comprised of bends in two different axes such that the contact surfaces of the first receptacle contact blade and the second receptacle contact blade converge towards each other over said angular range of mating directions, wherein, the receptacle housing has a partly cylindrical shape at the entrance of the receiving member having a center line which substantially coincides with the main pivoting axis, and wherein first and second connectors are hermaphroditic connectors, both provided with header housings and receptacle housings containing one or more header contact blades and receptacle contacts respectively, and wherein the first and second connectors are configured such that when the header housing and receptacle housing are coupled together as a connector, the coupling constrains relative motion of the header housing and receptacle housing to rotation about the main pivoting axis, and wherein the recess of the header housing of one of the connectors are sized and arranged to receive housing sections including the slot of the receptacle housing of the other connector when the header contact blade of the former connector is inserted into the entrance of the latter connector.

22. An assembly according to claim 21 wherein the first connector comprises receptacle and header contacts having surface mount ends positioned at an upper side of the connector and wherein the second connector comprises receptacle and header contacts having surface mount ends positioned at a lower side of the connector.

23. A method of manufacturing a receptacle contact for a hinged electrical connector assembly comprising a first connector and a second connector which are pivotable with respect to each other about a main pivoting axis, wherein the receptacle contact comprises a first receptacle contact blade and a second receptacle contact blade, and each of the first and second receptacle contact blades comprises an elongated conductive leg terminating in a free peripheral portion, wherein the contact surface of each of the first and second receptacle contact blades has a continuous curve comprised of bends in two different axes, the method comprising:

supplying a blank of an electro-conductive material having a base and two substantially parallel legs protruding from the base along respective longitudinal axes, forming two bends in different axes at a free end portion of each substantially parallel leg by curling the free end portion away from and transverse to the respective longitudinal axis of the substantially parallel leg such that the contact surfaces of the first receptacle contact blade and the second receptacle contact blade converge towards each other over an angular range of mating directions, such that an end surface at the distal most tip of each receptacle contact blade is bowed outwardly away from the other receptacle contact blade;

folding the legs into U-shapes about a first folding line extending transversely with respect to the legs, and folding the base about a second folding line extending parallel to the legs such that free end portions of the legs form opposite blades.

* * * * *